United States Patent [19]

Olsen

[11] Patent Number: 4,728,286

[45] Date of Patent: Mar. 1, 1988

[54] LAMP FOR LIQUID FUEL

[75] Inventor: Jan G. Olsen, Halden, Norway

[73] Assignee: Scandinavian Design Studio A/S, Halden, Norway

[21] Appl. No.: 913,653

[22] PCT Filed: Jan. 6, 1986

[86] PCT No.: PCT/NO86/00002

§ 371 Date: Sep. 26, 1986

§ 102(e) Date: Sep. 26, 1986

[87] PCT Pub. No.: WO86/04133

PCT Pub. Date: Jul. 17, 1986

[30] Foreign Application Priority Data

Jan. 7, 1985 [SE] Sweden ..... 8500042

[51] Int. Cl.[4] ..... F23D 3/24

[52] U.S. Cl. ..... 431/320; 362/180; 362/181

[58] Field of Search ..... 362/180, 181; 431/320, 431/321, 324

[56] References Cited

U.S. PATENT DOCUMENTS 41,172 1/1864 Wright ..... 362/180
167,108 8/1875 Marcy ..... 362/180
805,951 11/1905 Hamm ..... 362/181
3,697,739 10/1972 Novak et al. ..... 431/324

*Primary Examiner*—Carroll B. Dority

[57] ABSTRACT

A lamp for liquid fuel comprising a fuel container (3), a wick support (4) connected to an opening (15) in the container and a wick (5) supported by the wick support and connected to the container, such that fuel can be led by means of capillary forces from the container to the wick support. Also present is a frame arrangement (28) enabling the lamp to be stood or suspended. The container (3) is of the disposable type and is equipped not only with connecting organs (17) for the purpose of securing it in the frame arrangement (28), but also with securing organs (18) for the wick support (4). The frame arrangement is so executed as to accommodate the wick support inside it in such a way as not to be visible in the main from outside the lamp in its operating position. Essentially only the part (10) of the container with said opening is allowed to pass through, so that the wick support (4), when it is connected to the container, will be on the outside of the frame arrangement (28), in connection with which the frame arrangement should preferably exhibit means (36) for supporting a shade (29), such that the latter encloses the wick support and the intended flame (30).

3 Claims, 5 Drawing Figures

LAMP FOR LIQUID FUEL

The present invention relates to a lamp for liquid fuel comprising a fuel container, a burner connected to an opening in the container and a drawing up means, preferably a wick, connected to the container, such that fuel can be led by means of capillary forces from the container to the burner, in addition to which there is present a frame arrangement enabling the lamp to be stood or suspended.

Lamps for liquid fuel such as paraffin and other oil fractions have been known for some considerable time. They consist of a fuel container and a burner with some form of drawing up means for the fuel, usually in the form of a wick. The lamp can also include some kind of frame and a shade for the flame in the burner. Whereas in former times they represented an important source of lighting, lamps of this type, which are commonly known as oil lamps, are now used widely in the industrialized countries as decorative lighting, or 'lights to provide atmosphere'. In professional applications, for example in restaurants, where both financial and rational criteria are applied, the oil lamp has proved to be an easily handled means which, in comparison with candles, offers lower operating costs and easier maintenance and cleaning.

In professional use especially in restaurants there are high demands according to a rational and safe handling. It is very important that the liquid fluid not will bring bad smell or taste to food stuff. Of great importance is that the lamps by filling the fuel and by their use will bring as little risk as possible for fire in the inflameable fuel. As the until now used lamps of this type are based on old designs they will not fulfil high demands in said respect.

The object of the invention is to propose a lamp for liquid fuel in which handling and maintenance operations have been further simplified and made more economical in relation to previously disclosed models of such lamps.

A further object of the invention is to propose a lamp of the aforementioned kind which can be manufactured at low cost and which can easily be given a wide range of external appearances within the scope of a common technical principle.

The object of the invention is achieved through the lamp being characterized in that the container is of the disposable type and is equipped not only with connecting organs for the purpose of securing it in the frame arrangement, but also with securing organs for the wick support, and in that the frame arrangement is so executed as to accommodate the burner inside it in such a way as not to be visible in the main from outside the lamp in its operating position and is so arranged as to permit essentially only the part of the container with said opening to pass through to the outside, so that the wick support, when it is connected to the container, will be on the outside of the frame arrangement, in connection with which the frame arrangement should preferably exhibit means for supporting a shade, such that the latter encloses the burner and the intended flame.

Two embodiments of the lamp in accordance with the invention are shown in the accompanying drawings.

Figure 1:
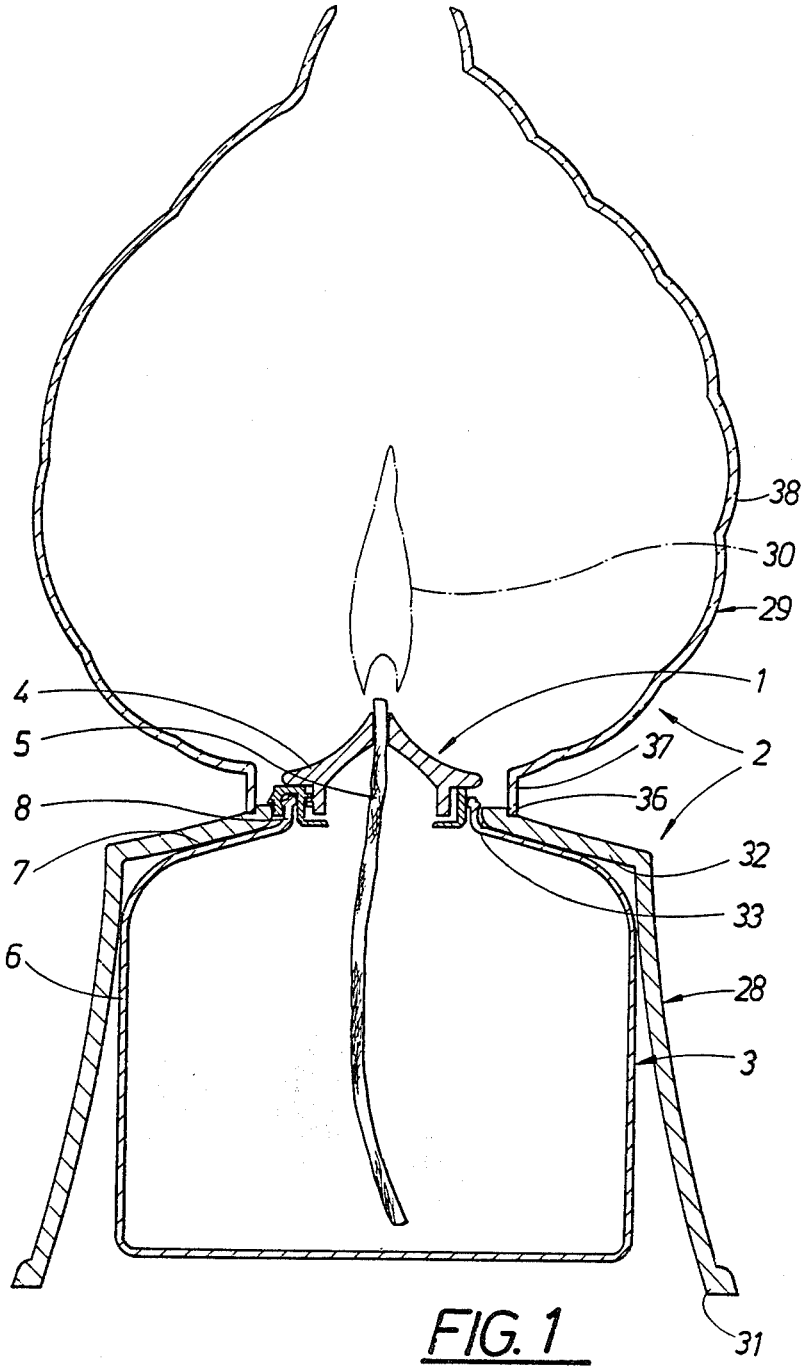
FIG. 1 shows a vertical section through the centre of the lamp in its first embodiment.

In accordance with FIG. 1 the lamp exhibits a functional part 1 and a decorative part 2. The functional part 1 comprises a container 3 for liquid fuel and a wick support 4, which supports a wick 5 hanging down into the container 3. More precisely, the container 3 consists of a container component 6 which, via a breast 7 is transformed into a neck 8. In accordance with FIG. 2 and FIG. 3, the neck exhibits a lip around the edge of an opening 9. This lip is used to retain a cover 10 for the container. The cover has an edge part 11 with three projecting parts 19 facing in a downward and outward sense, each of which forms a groove 12 shaped so as to be capable of being forced over the lip around the edge of the container and of being retained by its inherent flexibility on the opening 9. Ahead of the edge part 11 is arranged a central, recesed part 13 of which the centre part 14 is delimited by means of a circular groove 15. The centre part 14 is provided with a tongue 16 facing inwards towards the centre part, said tongue being intended to constitute a grip for the fingers enabling the centre part 14 to be torn away along the groove 15 in such a way as to reveal a hole leading to the interior of the container 3.

Each of the three projecting parts 19 exhibits on its outside a projection 17, and the inside of the edge part 11 in the recess 13 exhibits three projections 18.

The container 3 is intended to be of the disposable kind and is best made of a transparent plastic, with the lid being made of plastic or metal. It is supplied full of fuel, when it is sealed as shown by the dotted and dashed lines in FIG. 2 by means of a covering lid formed by the centre part 14.

The wick support 4 comprises a top part 20 with an end 21 from which a hole 22 extends through the wick support. The top part 20 is closed by means of a flange 23, which faces downwards in the operating position. From the flange 23 there projects a neck 24, which supports three projections 25. In the interests of saving material the hole 22 may be provided with an enlargement 26 at its lower end. The projections 25 of the wick support are so arranged as to interact with the projections 18 of the cover 10 in such a way that, when rotated into a certain position, the projections 25 of the wick support can be introduced downwards between the projections 18 of the cover. After the wick support has been rotated, its projections will lie beneath the projections of the cover, thereby securing the wick support. The respective projections are shown in the drawing to be set at an angle, so that on rotating the flange 23 will be forced against the upper part of the edge part 11 of the cover 10. This arrangement is thus a bayonet cap. The wick 5 is inserted via the hole 22 of the wick support 4. It consists in a previously disclosed fashion of a capillary material which may be a natural fibre material or alternatively an inorganic material such as metal fibres or mineral fibres.

The decorative part 2 can have various forms, although in a typical case it consists of a base 28 which serves the function of providing a frame enabling the lamp to be stood or suspended, and of a shade 29 for the purpose of shading the flame 30 which can be lit on the wick.

The base 28 exhibits a downward-facing fully open end 31 and a top end 32 with a hole 33. Three notches 34 are arranged in the hole 33 in accordance with FIG. 3. The diameter of the hole fits the external diameter of the edge part 11 of the cover 10, and the dimension across the projecting parts 19 of the cover is thus greater than the external diameter of the hole 33. The projecting parts 19 are so arranged, however, as to be capable of being introduced through the notches 34 once the container 3 has been rotated into a certain position. For this purpose, however, the projections 17 require to be clipped over the edges of the notches 34, when they will come to rest against these in such a way that the container is held securely.

The shade 29 shall be supported by the base 28, and in the embodiment shown an annular groove 36 in which an edge part 37 of the shade projects downwards is provided for this purpose. The shade in this embodiment otherwise consists of a main part 38 which is open to the top and which is so arranged as to allow the light to pass through it in a decorative manner. It may accordingly be made of a translucent material, which is assumed to be the case in the embodiment shown, or it may be perforated in the form of a lattice or ribbed pattern.

Figure 4:
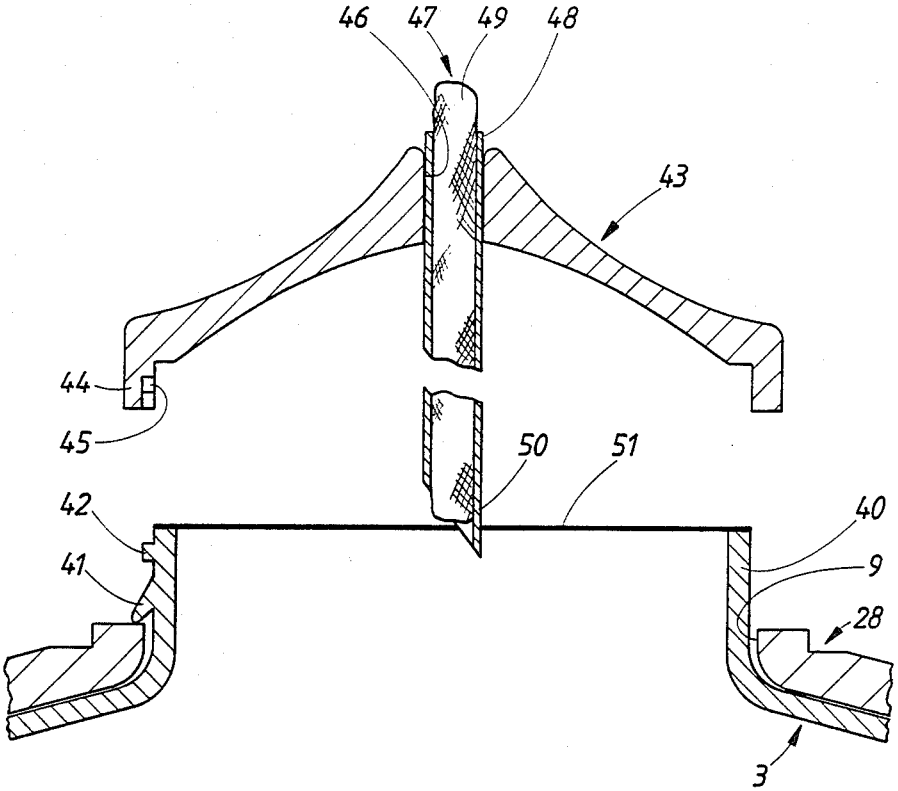
FIG. 4 shows the second embodiment in the same section as in FIG. 2.
Figure 5:
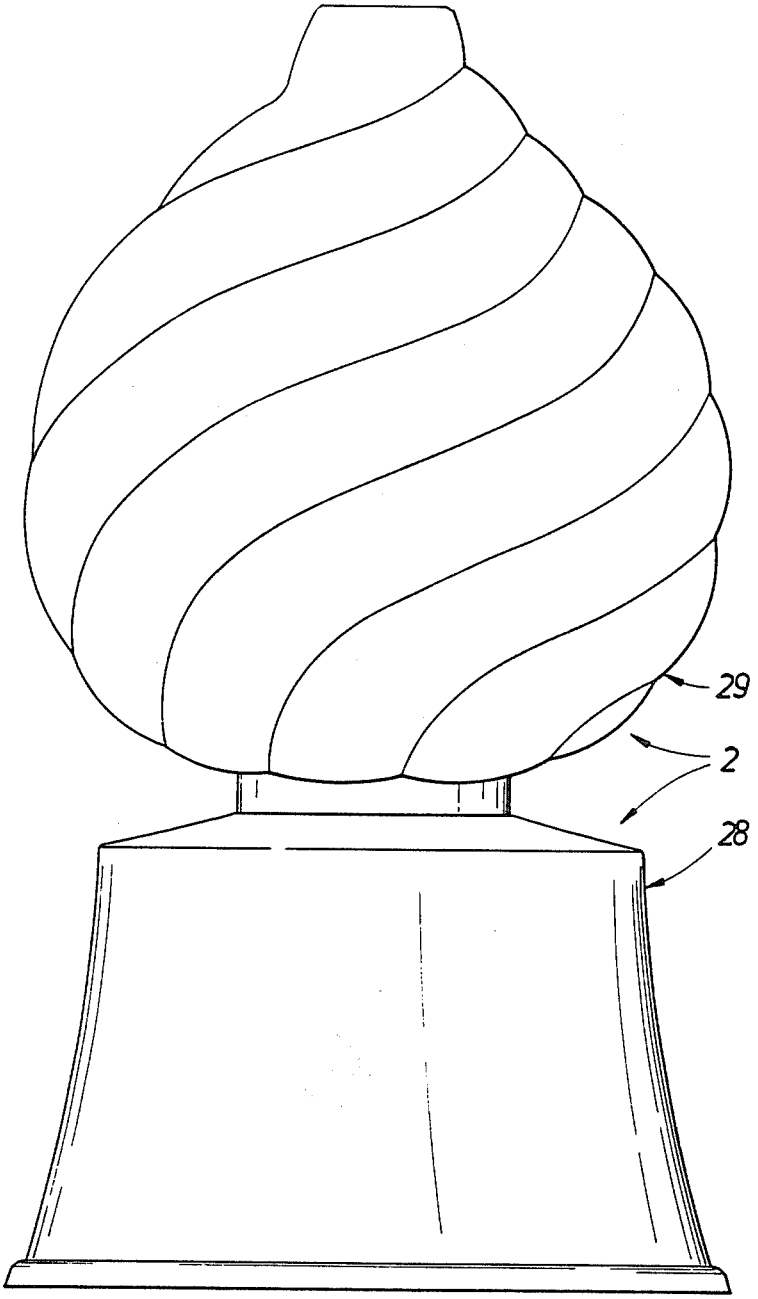
FIG. 5 shows the lamp in side view.

The composite lamp is shown in FIG. 4, and what is seen from the outside is consequently the decorative part 2 with its base 28 and shade 29. Of the functional part, the container 3 is concealed inside the base 28, and the upper part of the wick support 4 is concealed inside the shade 29. It must be stated in the interests of completeness that the wick support is shown in FIG. 1 to be partly inserted in the base, whereas in FIG. 2 it is shown in a slightly raised position.

As has already been mentioned, the fuel container 3 is intended to be of the disposable type and to be supplied full of fuel, and is also intended to be thrown away after the fuel has been used and to be replaced by a new, full container. The wick support 4 with the wick 5, on the other hand, is intended to be used again and again and to be transferred from container to container as the fuel is used. The wick support and in particular the wick may require to be replaced from time to time, however, and it has been assumed for this purpose that they will be available as spare parts. The permanent part of the lamp is the decorative part 2, and this can be given many forms, as has already been mentioned. It must be borne in mind, however, in connection with this that the dimensions at the hole 33 on the base shall be such as to permit the container 3 to be suspended in the base 28. The lower, internal width of the base and its height shall also be such as to accommodate the container.

The shade 29 shall also be such as not only to fit on the base 28, but also to enclose the burner and the flame at a suitable distance and in the manner determined by the desired light. It must be noted, furthermore, that the nature of the execution of the base 28 with the end 31 open towards the bottom facilitates the replacement of the container 3, at the same time as the base need not contain more material than is necessary for its suspension function and its decorative function. A bottom may thus be dispensed with because the fuel container is separate, and the base need not, therefore, be sealed. The bowl-shaped form is also easy to manufacture, irrespective of the material selected: ceramics, glass, plastic or pressed, cast metal. The shade 29 also has a simple form from the manufacturing point of view, and it has the simplest conceivable attachment to the base.

Figure 2:
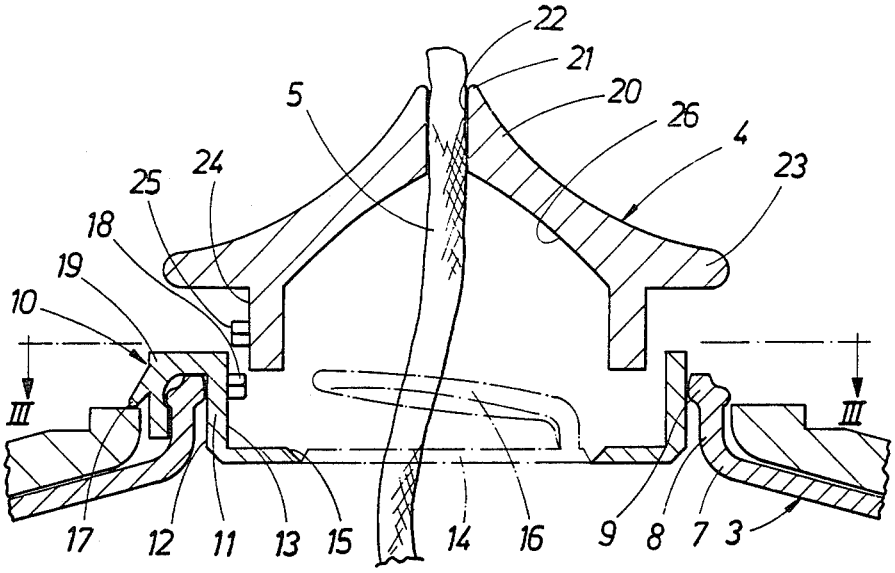
FIG. 2 shows a part of the same section, but on an enlarged scale.
Figure 3:
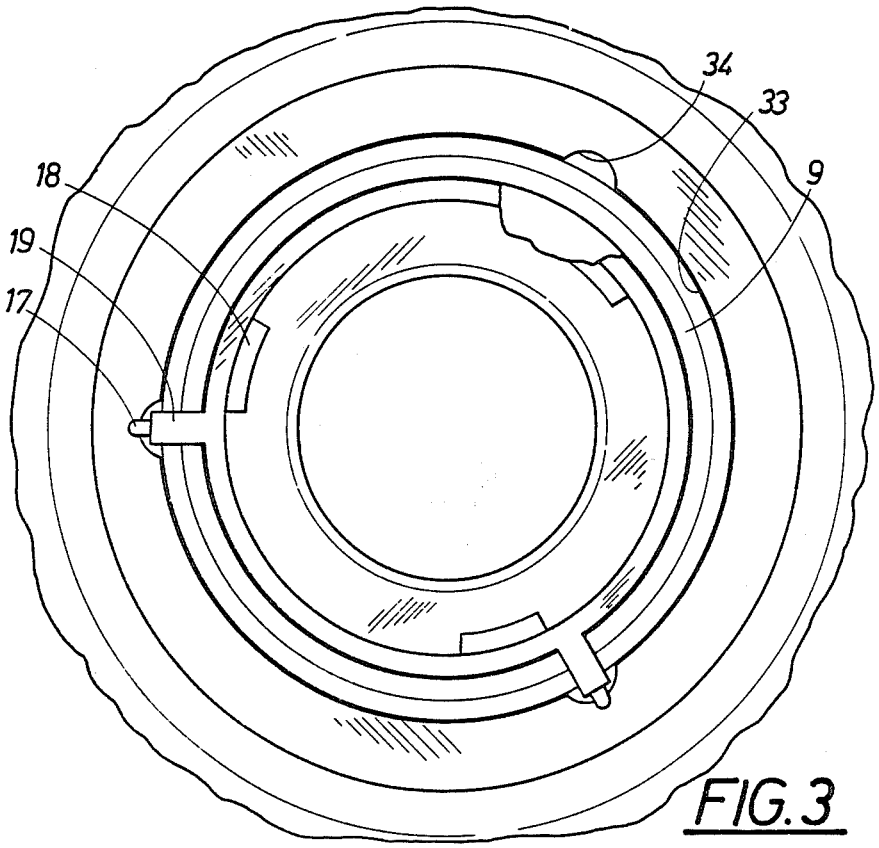
FIG. 3 shows a view from above taken from the line III—III in FIG. 2.

According to the second embodiment reference is made to FIG. 4 which shows an arrangement of the wick support and the portion including the opening of the container which is different to the same in FIG. 2. The fuel container has as before the reference numeral 3 and the base the reference numeral 28. The container exhibits a neck portion 40 opening upwards, which portion on its outside is provided with carrying means 41 for the carrying of the container in the opening 9 of the base 28 in a similar way as has been described before. For the carrying means 41 several alternative arrangement can be used e.g. threads or resilient tongues.

The neck portion 40 further exhibits adjacent to its outer end projections 42 forming a part of a bayonet attachment for the attaching of the wick support which here has the reference numeral 43. In said bayonet mounting is also included L-shaped grooves 45 on the inside of a lower portion 44 of the burner. By means of this arrangement the wick support can be pressed down over the neck portion 40 of the container and be locked by means of turning. Other kinds of attachments are also possible. It is also possible to attach the burner and the container separately from each other in the base 28 so they will be jointed together by means of the base.

In its upper portion the wick support is provided with a hole 46 in which a wick 47 is inserted. The wick consists in this case of two parts, an outer hard cover 48 and an inner organ 49, which is made of capillary material and will provide the wick with its suction function. The cover 48 has as well as the inner organ 49 such a length, that the wick unit is stretching down to the bottom of the container 3 when the wick support is attached to the same. The outer end of the cover 48 is provided with a point 50. For closing of the neck portion of the container 3 it is provided with a thin foil 51 stretching over its opening and attached to the container. The foil is shown partly pierced of the point 50 of the cover of the wick. Preferably the cover 48 is provided with a longitudinal groove, which is intended to form an air channel for delivering air into the container as the fuel is consumed.

Notwithstanding in those respects which have already been mentioned, the base can be executed in a wide range of different fashions. Various materials have been mentioned for the base of the lamp. It can be given a simple, smooth form or a more ornamented form. It can also be provided with suspension means, for example pegs enabling it to be hung from a wall bracket. The shade in turn can be made from a single piece of moulded glass, for example, or from ceramics perforated to produce a lattice pattern. The shade can also be executed in a similar fashion from stamped metal sheet or by producing it from sheet metal tubing. Shades composed of a number of parts are also conceivable.

In the following the use of the lamp in its first embodiment will be described with reference in the first hand to FIG. 2.

Replacement of the container will be necessary when the lamp is used, on the assumption that it has burned for a certain period so that the container 3 is empty. The shade 29 must be removed for this purpose. The wick support 4 and the wick 5 are then removed. This can be done by first rotating the wick support so that the projections 17 and 25 align with each other, enabling the burner to be withdrawn.

The base 28 is now raised so that the container 3 is accessible from the open end 31. By withdrawing the container so that the projections 17 snap out of the notches 34, it will be possible to withdraw the container through the hole 33 enabling it to be removed.

A new container is now taken, and the sealing cover formed by the centre part 14 in the cover 10 is removed by tearing along the groove 15. The edge part 11 of the cover 10 of the container is then introduced into the opening 33 on the base 28 with the projections 17 so positioned as to pass through the notches 34. Once it has been introduced and the projections 17 have been clipped into position, the container will be held securely in the opening by means of the projections 17 resting against its edge.

The base 28 can now be set down on its supporting surface, and the wick support 4 can be introduced so that the wick 5 hangs down into the full container. The wick support is then secured to the cover 10 of the container by rotating the projections 18 and 25 into engagement with each other, so that the flange 23 is forced against the edge part 11 of the cover. Finally, the shade 29 is attached, and the lamp is now ready for use. The lamp is lit by lowering a match or similar to the wick, if necessary after first having removed the shade.

What has been mentioned according to the use of the first embodiment has to its substantial part relevance also to the second embodiment. However, the wick support 43 is connected in a more simple way, see FIG. 4. By storing the container 3 is entirely tight by being closed by means of the foil 51. In this condition its is attached to the base 28. When the wick support has to be connected the point 50 of the cover 48 is pressed through the foil 51 and can be inserted in the container down to its bottom. Thereafter the wick support is locked to the container by means of the bayonet mounting 42, 45.

In order to prevent the foil 51 to seal around the cover 48 it is provided with the mentioned groove which will form an air channel.

The lamp can be given forms other than that evident from the embodiment described to a certain extent above. The lamp can also be varied, however, with regard to details such as the securing means for the container in the base and for the wick support in the container, and screw threads may be used, for example, instead of the bayonet connection and snap lock illustrated. Other forms for the wick support itself can be derived from previously disclosed techniques, and these are also included within the scope of the following Patent claims.

I claim:

1. A lamp for liquid fuel comprising: frame means, a fuel container carried in the frame means and having an upwardly turned neck forming an opening, a wick support positioned in said opening of the container, wick means supported by the wick support and extending into the container for leading fuel by capillary action from the container, said frame means being bowl-shaped with a wide, downwardly turned opening and an upper portion opposite thereto and including an opening said wick support having a securing means, said container being dimensioned to be introduced through the downwardly turned opening of the frame means and having securing means at said opening of the container to cooperate both with the securing means of the wick support and the opening in the upper portion of said frame means for securing the container to the wick support at the upper portion of the frame means in a hanging position within the bowl-shaped frame means.

2. A lamp as claimed in claim 1, wherein; said securing means includes a sealing foil over the opening in the container, the wick means comprising a capillary member and a hard part extending along said capillary member and having an end for piercing the foil and to be situated in the container.

3. A lamp as claimed in claim 2, in which the hard part is a cover enclosing the capillary member, said cover having a groove which provides an air channel at an edge connecting the foil to said cover.

* * * * *